United States Patent [19]

Duenkelmann

[11] Patent Number: 4,867,422

[45] Date of Patent: Sep. 19, 1989

[54] ROTARY DEVICE, APPARATUS AND METHOD FOR TREATING MOLTEN METAL

[75] Inventor: Dietger Duenkelmann, Bocholt, Fed. Rep. of Germany

[73] Assignee: Foseco International Limited, Birmingham, United Kingdom

[21] Appl. No.: 306,054

[22] Filed: Feb. 6, 1989

[30] Foreign Application Priority Data

Feb. 24, 1988 [GB] United Kingdom ..... 8804267

[51] Int. Cl.[4] ..... C21C 7/00

[52] U.S. Cl. ..... 266/216; 75/61

[58] Field of Search ..... 75/61; 266/216

[56] References Cited

U.S. PATENT DOCUMENTS

| | | | |
|---|---|---|---|
| 3,802,872 | 4/1974 | Ostberg | 75/61 |
| 3,972,709 | 8/1976 | Chia | 75/61 |
| 4,018,598 | 4/1977 | Markus | 75/61 |
| 4,611,790 | 9/1986 | Otsuka | 266/217 |
| 4,634,105 | 1/1987 | Withers | 266/217 |
| 4,670,050 | 6/1987 | Ootsuka et al. | 75/68 R |
| 4,717,540 | 1/1988 | MaRae | 75/61 |
| 4,743,428 | 5/1988 | MaRae | 75/61 |

FOREIGN PATENT DOCUMENTS 0262058 3/1988 European Pat. Off. .

*Primary Examiner*—Peter D. Rosenberg

*Attorney, Agent, or Firm*—Nixon & Vanderhye

[57] ABSTRACT

A rotary device for dispersing gas in molten metal comprises a hollow shaft and a hollow rotor attached to the shaft, the rotor having a plurality of vanes extending from the shaft towards the periphery of the rotor and dividing the rotor into a plurality of compartments, each compartment having an inlet adjacent the shaft and an outlet adjacent the periphery of the rotor, and the rotor having means for passing gas from the discharge end of the shaft into the compartments, wherein the discharge end of the shaft opens into a manifold in the rotor and the inlets for the compartments are present in the wall of the manifold. When the device is rotated in molten metal contained in a vessel and gas is passed down the shaft, metal is drawn into the manifold and breaks up the gas stream emerging from the shaft into very small bubbles. The gas/metal dispersion flows into the compartments through the inlets and out through the peripheral outlets and the gas is dispersed through the whole body of molten metal.

13 Claims, 2 Drawing Sheets

ROTARY DEVICE, APPARATUS AND METHOD FOR TREATING MOLTEN METAL

This invention relates to a rotary device, apparatus and a method for treating molten metal wherein a gas is dispersed in the molten metal. The device, apparatus and method are of value in the treatment of a variety of molten metals such as aluminium and its alloys, magnesium and its alloys, copper and its alloys and ferrous metals. They are of particular value in the treatment of molten aluminium and its alloys for the removal of hydrogen and solid impurities and they will be described with reference thereto.

It is well known that considerable difficulties may arise in the production of castings and wrought products from aluminium and its alloys due to the incidence of defects associated with hydrogen gas porosity. By way of example, the formation of blisters during the production of aluminium alloy plate, sheet and strip may be mentioned. These blisters, which appear on the sheet during annealing or solution heat treatment after rolling, are normally caused by hydrogen gas diffusing to voids and discontinuities in the metal (e.g. oxide inclusions) and expanding to deform the metal at the annealing temperature. Other defects may be associated with the presence of hydrogen gas such as porosity in castings.

It is common practice to treat molten aluminium and its alloys for the removal of hydrogen and solid impurities by flushing with a gas such as chlorine, argon or nitrogen or a mixture of such gases.

In U.S. patent application publication No. EP-A-0183402 there is described and claimed a rotary device for dispersing a gas in molten metal, the device comprising a hollow shaft, a rotor attached to the shaft, the rotor having a plurality of vanes extending from the shaft to the periphery of the rotor and dividing the rotor into a plurality of compartments, each compartment having an inlet adjacent the shaft and an outlet adjacent the periphery of the rotor and means for passing gas from the discharge end of the shaft into the compartments so that when the rotary device rotates in molten metal, metal entering a compartment through an aperture breaks up a stream of gas leaving the shaft into bubbles which are intimately mixed with the molten metal adjacent the shaft and the resulting dispersion of gas in molten metal flows through the compartment before flowing out of the rotor through the peripheral outlet of the compartment. All the disclosure of the earlier document is incorporated herein merely by this reference.

In that device, the shaft and the rotor may be integrally formed or they may be formed separately and fixed together, and the gas is passed via ducts from the main passageway of the shaft into each of the compartments.

It has now been discovered that if an alternative means is used to pass gas from the shaft to the compartments, it is possible to make the rotor more compact in a relatively simple and cheap way.

According to the invention there is provided a rotary device comprising a hollow shaft, and a hollow rotor attached to the shaft, the rotor having a plurality of vanes extending from the shaft towards the periphery of the rotor and dividing the rotor into a plurality of compartments, each compartment having an inlet adjacent the shaft and an outlet adjacent the periphery of the rotor, and the rotor having means for passing gas from the discharge end of the shaft into the compartments, wherein the discharge end of the shaft opens into a manifold in the rotor and the inlets for the compartments are present in the wall of the manifold of the rotor.

It is a much preferred feature of the invention that the rotor is formed separately from the shaft and the two are fixed together by a releasable fixing means such as a threaded tubular connection piece. As a result it is simple to make a rotor which can be more compact. The rotor of the invention can be machined from a solid block and the compartments can be formed readily by a milling operation. The block may be made of a suitable material such as graphite.

A device of the invention can be rotated at fast speed and pass a large volume of gas.

The invention includes apparatus for treating molten metal comprising a vessel and the rotary device defined above and a method of treating molten metal comprising dispersing a gas in molten metal in a vessel by means of the rotary device defined above.

The vessel used in the apparatus and method of the invention may be a ladle, a crucible or a furnace such as a holding furnace, which may be used for the treatment of the molten metal by a batch process or the vessel may be a special construction such as that described in No. EP-A-0183402, in which the molten metal may be treated by a continuous process.

The gas which is used in the method of the invention may be for example argon, nitrogen, chlorine or a chlorinated hydrocarbon, or a mixture of two or more such gases.

The rotor is preferably circular in transverse cross-section in order to reduce drag in the molten metal when the device rotates and to minimise the mass of the rotor.

Rotors of a wide range in size, for example 100 mm to 350 mm in diameter may be used in the rotary devices of the invention. For the treatment of molten aluminium in a ladle or similar vessel by a batch process, rotors of diameter from 175 mm to 220 mm have been particularly satisfactory while for the treatment of aluminium in a special construction on a continuous basis a larger rotor, for example of the order of 300 mm diameter, is preferred. In general, the larger the rotor the more gas the rotor is capable of dispersing in a molten metal bath.

The rotor acts as a pump and the faster it rotates the more molten metal it can pump thus increasing efficiency of degassing due to increased contact between molten metal and the gas. At reduced speeds pumping efficiency is decreased. For a given size of rotor there is a minimum speed necessary to achieve distribution of fine diameter gas bubbles throughout the molten metal contained in the vessel and the minimum speed is a function of the flow rate of the purging gas. The more gas it is desired to introduce into the molten metal in a given time the faster is the required rotor speed for a particular rotor and the larger the rotor the more gas it will disperse.

For rotors of 175 mm to 220 mm diameter the minimum speed is of the order of 300 to 350 rpm and the preferred speed is 400 to 600 rpm, while for rotors 300 mm or more in diameter, the minimum speed is about 225 rpm and the preferred speed is 400 to 450 rpm.

For the smaller rotors, i.e. of 175 to 220 mm diameter, the gas flow rate will usually be from 12–30 liters per minute, more usually 22–24 liters per minute for argon, nitrogen, mixtures of argon and nitrogen or for mixtures of an inert gas such as argon with an active gas such as chlorine, for example a mixture containing 1–10% by volume chlorine. For larger rotors, i.e. of 300 mm diameter the gas flow rate will usually be from 30–80 liters per minute and is typically 60 liters per minute.

As described above the smaller rotors, i.e. of 175 to 220 mm diameter are usually used for treating molten metal in a vessel such as a ladle. The shape of the ladle can influence the choice of rotor size but in general rotors of 175–190 mm are used to treat batches of 250–600 kg of metal and rotors of 200–220 mm are used to treat batches of 600–900 kg of metal. Treatment times using rotors of 175 to 220 mm diameter usually range from 1–10 minutes. Larger rotors, i.e. of 300 mm diameter, which are used to treat molten metal on a continuous basis are capable of treatment at a flow rate of metal of up to 500 kg per minute with a residence time in the treatment vessel of approximately 2 to 10 minutes.

The effectiveness of the rotors of the invention in the degassing of aluminium and aluminium alloys can be assessed by the determination of the Density Index of the metal before and after treatment without the need to make hydrogen gas content determinations on actual samples. The higher the Density Index of an aluminium sample then the higher is the hydrogen gas content of the aluminium.

The Density Index (DI) is determined from the formula $$DI = \frac{Datm - D80\text{mbar}}{Datm} \times 100$$

where Datm is the density of a sample of metal which has been allowed to solidify under atmospheric pressure and D80 mbar is the density of a sample which has been allowed to solidify under a vacuum of 80 mbar.

In metal casting practice it is recognised that to be satisfactory aluminium castings should have particular Density Index values. For example wheels should have values of 5–8, cylinder head castings should have values of less than 5, sand castings should have values of less than 2 and vacuum/pressure diecastings should have values of less than 1.

In order that the invention may be well understood it will now be described with reference to the accompanying diagrammatic drawings in which.

Figure 1:
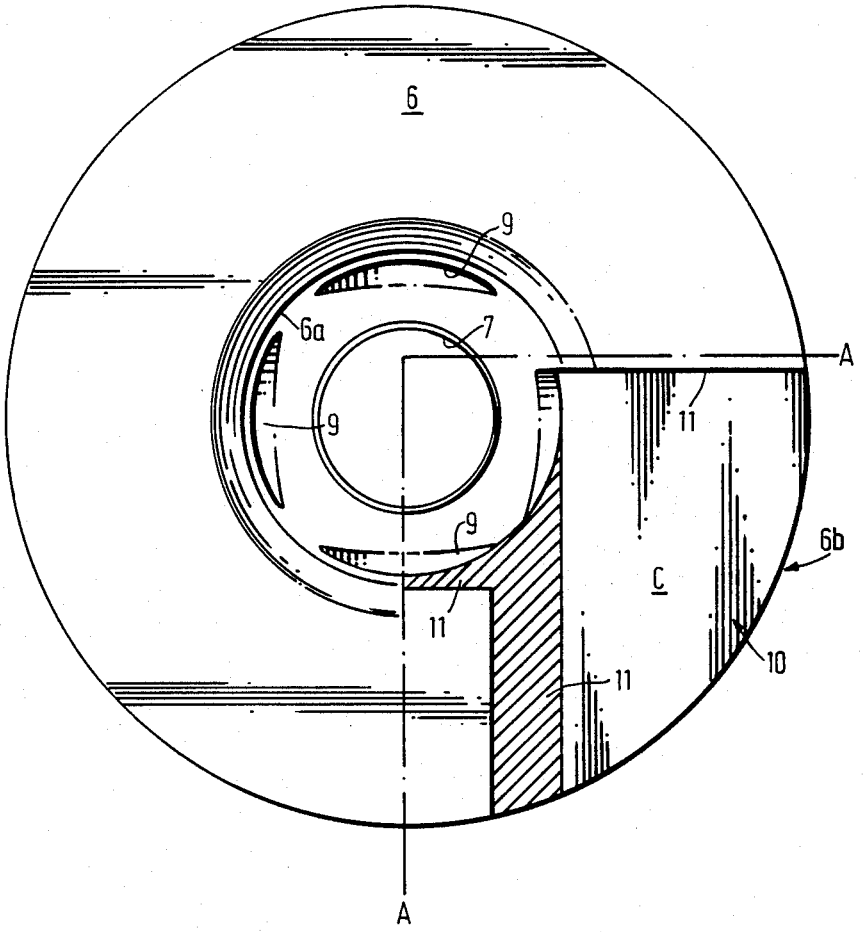
FIG. 1 is an underneath plan view of the rotor of the invention.
Figure 2:
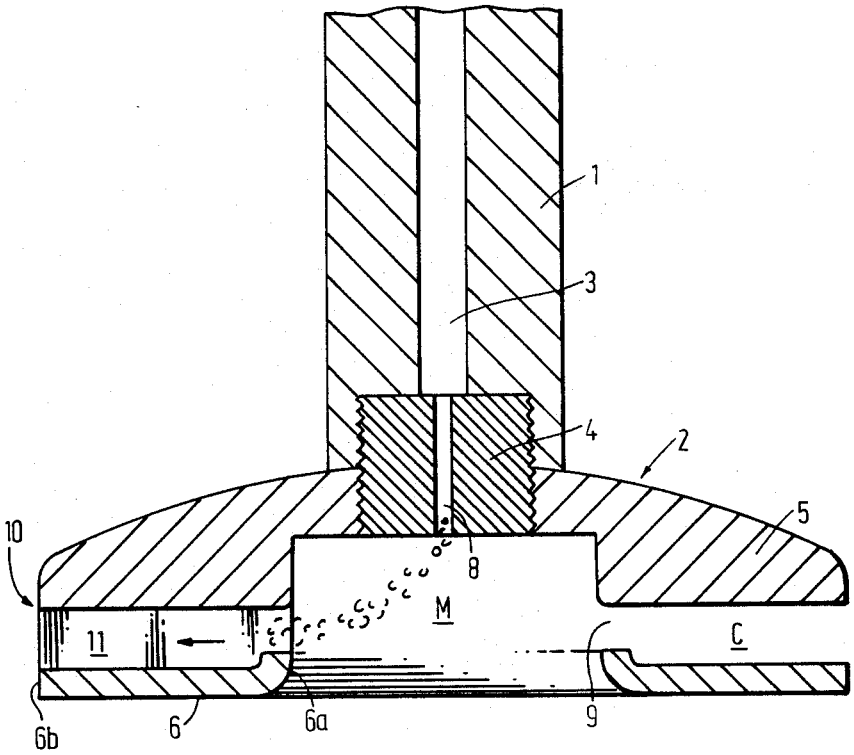
FIG. 2 is a vertical section through the rotor of FIG. 1 in assembly with the gas delivery shaft.

Referring to the drawings a rotary device for dispersing a gas in molten aluminium comprises a gas delivery shaft 1 and a rotor 2. The shaft 1 has a throughbore 3, about 16 mm in diameter and at its lower end is internally threaded to receive a longitudinal portion of a threaded tubular connection piece 4 which has external threads. The rotor 2 comprises a one piece moulding of e.g. graphite and comprises a generally disc or saucer-like body having an annular roof 5 from which extends an underlying circular wall 6. The centre of the roof 5 contains an internally threaded socket 7 to receive a threaded length of the lower part of the connection piece 4. The piece 4 has a throughbore having a diameter of about 3 mm. The area below the socket 7 is open to define a manifold chamber M, and the free end 8 of the piece 4 opens into the manifold M, for purposes to be described below. The wall 6 contains four compartments C which extend from the inside of the wall **6*a* to the outside of that wall 6*b* which defines the rim of the rotor body. Each compartment C has an inlet aperture 9 in the wall 6*a* and an outlet in the form of an elongate slot 10 at the rim of the rotor. Adjacent compartments C are separated by vanes 11. The wall 6 defines the wall of the manifold chamber M which is open to the molten metal so that, as explained below, gas leaving the outlet 8 can be passed together with molten metal into each compartment C via the inlet 9 and exit via the outlet 10**.

The shaft is connected to the lower end of a hollow drive shaft (not shown) whose upper end is connected to drive means, such as an electric motor, (not shown) and the bore 3 is connected through the hollow drive shaft to a source of gas (not shown).

The rotary device is located inside a refractory lined ladle or other vessel. The rotary device is rotated in the molten aluminium contained in the ladle and gas is passed down the bore 3 of the shaft 1 to emerge via the end 8 at the top end of the manifold M. As the device rotates aluminium is drawn into the manifold M through the lower open mouth and in the manifold the metal breaks up the gas stream leaving the outlet 8 into very small bubbles which are intimately mixed with the aluminium. The dispersion formed flows into the compartments C via the inlets 9 through the compartments C and out of the peripheral outlet 10 and is dispersed through the whole body of the molten aluminium. Aluminium contained in the ladle is thus intimately contacted by the gas and dissolved hydrogen and inclusions are removed.

The following examples will serve to illustrate the invention.

For each example two samples of aluminium were taken before and after treatment. One sample was allowed to solidify at atmospheric pressure and the other sample was solidified under a vacuum of 80 mbar, care being taken to ensure that during solidification hydrogen bubbles did not break through the top surface of the sample. Density Index (DI) values were determined before and after treatment from density measurements on the solidified samples.

EXAMPLE 1

An aluminium-silicon-magnesium alloy containing 7% silicon was treated in a 500 kg holding furnace using nitrogen gas and a device incorporating a 190 mm diameter rotor as shown in the drawings. The rotor speed was 600 rpm, the nitrogen flow rate 22 liters per minute and treatments were carried out for 3 and 5 minutes. The results are shown in the table below.

EXAMPLE 2

An aluminium-silicon-copper alloy containing 8% silicon and 3% copper was treated in a 500 kg transfer ladle using argon gas and a device incorporating a 190 mm diameter rotor as shown in the drawings. The rotor speed was 600 rpm, the argon flow rate was 24 liters per minute and treatments were carried out for 3, 4 and 5 minutes. The results are shown in the table below.

EXAMPLE 3

An aluminium-silicon-magnesium alloy containing 9% silicon was treated in a 500 kg crucible furnace using nitrogen gas and a device incorporating a 190 mm diameter rotor as shown in the drawings. The rotor speed was 600 rpm, the nitrogen flow rate was 22 liters per minute and the treatment was carried out for 4 minutes. The results are shown in the table below.

EXAMPLE 4

An aluminium-silicon-magnesium alloy containing 10% magnesium was treated in a 400 kg crucible furnace using argon gas and a device incorporating a 190 mm diameter rotor as shown in the drawings. Treatment took place immediately after modification of the alloy using sodium tablets. The rotor speed was 600 rpm, the argon flow was 22 liters per minute and treatments were carried out for 3, 5 and 6 minutes. The results are shown in the table below.

EXAMPLE 5

An aluminium-silicon-magnesium alloy containing 11% silicon was treated in a 500 kg transfer ladle using argon gas and a device incorporating a 190 mm diameter rotor as shown in the drawings. The rotor speed was 600 rpm, the argon flow rate was 24 liters per minute and treatments were carried out for 2, 3 and 4 minutes. The results are shown in the table below.

| EXAMPLE | TIME (MINUTES) | METAL TEMPERATURE (°C.) | DI BEFORE | DI AFTER |
|---|---|---|---|---|
| 1 | 3 | 810 | 18.1 | 6.8 |
| | 5 | 810 | 16.2 | 3.4 |
| 2 | 3 | 751 | 17.2 | 2.0 |
| | 4 | 741 | 11.3 | 0.4 |
| | 5 | 806 | 14.9 | 0.1 |
| 3 | 4 | 740 | 14.6 | 2.1 |
| 4 | 3 | 795 | 7.4 | 2.9 |
| | 5 | 780 | 12.7 | 0.4 |
| | 6 | 748 | 5.2 | 0.04 |
| 5 | 2 | 760 | 12.0 | 7.9 |
| | 3 | 760 | 12.5 | 3.9 |
| | 4 | 780 | 13.8 | 2.2 |

I claim:

1. A rotary device comprising: a hollow shaft having a gas discharge end; a hollow rotor attached to the shaft, the rotor having a periphery, and a plurality of vanes extending from the shaft towards the periphery of the rotor and dividing the rotor into a plurality of compartments, each compartment having an inlet adjacent the shaft and an outlet adjacent the periphery of the rotor; the rotor having means for passing gas from the discharge end of the shaft into the compartments; wall means defining a manifold open at a first end thereof, the discharge end of the shaft opening into said manifold in the rotor at a second end thereof, generally opposite said first end; and wherein the inlets for the compartments are present in the wall means of the manifold of the rotor, between said first and second ends thereof.

2. A rotary device according to claim 1 wherein the rotor is formed separately from the shaft and the rotor and shaft are fixed together by a releasable fixing means.

3. A rotary device according to claim 1 wherein the releasable fixing means is a threaded tubular connection piece.

4. A rotary device according to claim 1 wherein the rotor is circular in transverse cross-section and has a diameter of 100 mm to 350 mm.

5. Apparatus for treating molten metal comprising: a vessel, and a rotary device, comprising: a hollow shaft having a gas discharge end; a hollow rotor attached to the shaft, the rotor having a periphery, and a plurality of vanes extending from the shaft towards the periphery of the rotor and dividing the rotor into a plurality of compartments, each compartment having an inlet adjacent the shaft and an outlet adjacent the periphery of the rotor; the rotor having means for passing gas from the discharge end of the shaft into the compartments; wall means defining a manifold open at a first end thereof, the discharge end of the shaft opening into said manifold in the rotor at a second end thereof, generally opposite said first end; and wherein the inlets for the compartments are present in the wall means of the manifold of the rotor, between said first and second ends thereof.

6. Apparatus according to claim 5 wherein the vessel is a ladle, crucible or furnace.

7. A rotary device as recited in claim 1 wherein said shaft discharge end, manifold, and inlets for the compartments are arranged so that as the rotor rotates molten metal is drawn into the first end of the manifold and in the manifold breaks up gas introduced from the discharge end of the shaft, so that the gas is formed into very small bubbles which are intimately mixed with the metal to form a dispersion, the dispersion flowing into the compartments through the inlets and out of the compartments through the outlets.

8. Apparatus as recited in claim 5 wherein said shaft discharge end, manifold, and inlets for the compartments are arranged so that as the rotor rotates molten metal is drawn into the first end of the manifold and in the manifold breaks up gas introduced from the discharge end of the shaft, so that the gas is formed into very small bubbles which are intimately mixed with the metal to form a dispersion, the dispersion flowing into the compartments through the inlets and out of the compartments through the outlets.

9. A device as recited in claim 1 wherein said rotor comprises a one-piece molding.

10. Apparatus as recited in claim 5 wherein said rotor comprises a one-piece molding.

11. A device as recited in claim 9 wherein said rotor is of graphite.

12. Apparatus as recited in claim 10 wherein said rotor is of graphite.

13. A method as recited in claim 7 wherein steps (a) and (b) are practices so that as the molten metal enters through the open end of the manifold it breaks up gas supplied by the discharge end of the shaft into very small bubbles which are intimately mixed with the molten metal into a dispersion, the dispersion flowing through the inlets into the compartments and out of the compartments through the outlets.

* * * * *

UNITED STATES PATENT AND TRADEMARK OFFICE

CERTIFICATE OF CORRECTION

PATENT NO. : 4,867,422

DATED : September 19, 1989

INVENTOR(S) : DUENKELMANN

It is certified that error appears in the above-identified patent and that said Letters Patent is hereby corrected as shown below:

Column 6, lines 54-61, claim 13 is directed to a non-elected invention and should be deleted.

Signed and Sealed this

Twenty-fifth Day of September, 1990

*Attest:*

HARRY F. MANBECK, JR.

*Attesting Officer*

*Commissioner of Patents and Trademarks*